US008596199B2

(12) United States Patent
Buttolph et al.

(10) Patent No.: US 8,596,199 B2
(45) Date of Patent: Dec. 3, 2013

(54) PROJECTILE BEARING SYSTEM

(75) Inventors: Martin Edwy Buttolph, Middlebury, VT (US); John Christiana, Huntington, VT (US)

(73) Assignee: Simmonds Precision Products, Inc., Vergennes, VT (US)

( * ) Notice: Subject to any disclaimer, the term of this patent is extended or adjusted under 35 U.S.C. 154(b) by 0 days.

(21) Appl. No.: 13/396,285

(22) Filed: Feb. 14, 2012

(65) Prior Publication Data

US 2013/0206030 A1 Aug. 15, 2013

(51) Int. Cl.
*F42B 10/02* (2006.01)

(52) U.S. Cl.
USPC ..... 102/293; 102/473; 102/517; 244/3.23

(58) Field of Classification Search
USPC ..... 102/473, 490, 501, 517, 524, 293; 244/3.23, 3.24, 3.27, 3.28, 3.29
See application file for complete search history.

(56) References Cited

U.S. PATENT DOCUMENTS

| | | | | |
|---|---|---|---|---|
| 6,604,705 | B2 * | 8/2003 | Pellegri et al. | 244/3.24 |
| 8,319,163 | B2 * | 11/2012 | Flood et al. | 244/3.24 |
| 2011/0024550 | A1 | 2/2011 | McDermott et al. | |
| 2012/0181376 | A1 * | 7/2012 | Flood et al. | 244/3.27 |

OTHER PUBLICATIONS

James L. Sitomer, "Precision-guided projectiles," Access Science, 2001 © McGraw-Hill Companies, http://www.accessscience.com.
George Fotieo, "Gun Launch Dynamics of the Navy 5-Inch Guided Projectile," Martin Marietta Aerospace, Orlando, Florida.

* cited by examiner

*Primary Examiner* — James Bergin
(74) *Attorney, Agent, or Firm* — Cantor Colburn LLP

(57) ABSTRACT

A bearing system for a spin-stabilized projectile including bearing configurations that permit selective relative rotation between a spindle and a body portion and which facilitate automatic centering of the spindle. Each bearing configuration includes a conical bearing surface rotatable with respect to a corresponding conical body surface. One bearing configuration is in a forward portion of the body portion and selectively engages a first body surface upon the projectile experiencing set-back forces to direct forces away from bearing elements, and another bearing configuration is in a rearward portion of the body portion and engages a second body surface upon the projectile experiencing set-forward forces to direct forces away from the bearing elements. Biasing elements work in cooperation with the bearing configurations to automatically maintain the spindle centered with respect to the body portion during pre-launch and in-flight and to re-center the spindle after set-back, balloting and/or set-forward phases.

20 Claims, 12 Drawing Sheets

PROJECTILE BEARING SYSTEM

BACKGROUND

This invention relates generally to a bearing system for a launched projectile, and in at least one embodiment, relates to an internal bearing system for a spin-stabilized and/or a fin-stabilized projectile.

Spin-stabilized projectiles may include a guided portion which, after initially spinning upon launch, becomes relatively stationary compared to another portion of the projectile that continues to spin. The stationary portion may include aerodynamic surfaces which may be manipulated to assist in ultimately guiding the projectile towards a target. Similarly, fin-stabilized projectiles, which have both rear fins and forward canard fins, could use rear-mounted fins for guiding the projectile.

Lightweight, low-drag bearings may be desirable for use in such projectiles, as bearings used in spin-stabilized projectiles must survive excessively large loads, such as during the set-back, balloting, and set-forward phases during launch. Such an arrangement may be desirable for the nose and/or tail section in either a spin-stabilized or fin-stabilized projectile.

Also, it may be desirable to size the projectile's bearings more for in-flight loads than for launch loads, since such in-flight loads are typically much lower than launch loads.

Additionally, lighter-weight bearings may result in a lighter-weight projectile, which may in turn, aid in improved stability and on-target delivery and/or increased warhead carrying capability.

As used herein, "set-back" refers to the phenomenon of internal components within the body portion of the projectile tending to resist motion and shift rearwardly relative to the body portion as the projectile experiences forward motion upon being subjected to the acceleration forces from a launch. The term, "set-forward," as used herein, refers to how the internal components within the body portion of the projectile, upon being released from the forces causing set-back, tend to rebound and move forward relative to the body portion and how such components may oscillate with respect to the body portion until general equilibrium is reached. The term, "balloting," as used herein, refers to the motion induced to the projectile and its internal components as the projectile in essence bounces laterally back and forth, in contacting the interior of the barrel as it moves down the barrel during launch. Balloting also refers to the movement the projectile experiences as it is exposed to the forces of gases exiting the barrel around the projectile as it leaves the barrel. Balloting can occur during setback, before set-forward, and/or during set-forward. As used herein, "in-flight" loads or forces refers to aerodynamic loads experienced by the projectile in flight and also to imperfections and/or anomalies in the projectile which may tend to cause imbalance in the projectile as it spins.

SUMMARY

Generally, one embodiment of the present invention may include a bearing system for a projectile having a longitudinally extending body portion with a forward portion and a rearward portion and a spindle, the projectile being subject to pre-launch, launch, set-back, set-forward, balloting, and in-flight forces. Such bearing system comprises a first bearing configuration having a first member, and a second bearing configuration having a second member. The first bearing configuration and the second bearing configuration may be configured to permit selective relative rotation between the body portion and the spindle about a central axis. The first member defines a first bearing surface extending at a first angle with respect to the central axis, and a first engagement portion is fixed relative to the body and defines a first engagement surface extending at an angle substantially complimentary to the first angle of the first bearing surface. The second member defines a second bearing surface extending at a second angle with respect to the central axis, and a second engagement portion is fixed relative to the body and defines a second engagement surface extending at an angle substantially complimentary to the second angle of the second bearing surface. The first bearing surface is configured to engage the first engagement surface upon the projectile experiencing set-back forces and to be substantially disengaged from the first engagement surface upon the projectile experiencing set-forward forces. The second bearing surface may be configured to be substantially disengaged from the second engagement surface upon the projectile experiencing set-back forces and to engage the second engagement surface upon the projectile experiencing set-forward forces.

In one embodiment of the present invention, a spin-stabilized projectile is provided having a relatively lighter-weight bearing system employing rotationally complimentary bearing surface interfaces, such as conical, concave-convex, etc. interfaces for a rotatable spindle that transfer launch (set-back, set-forward, balloting), and pre-launch and/or in-flight equilibrium loads within the projectile and which, in combination with springs or other suitable biasing elements, serve to automatically re-center the spindle upon the spindle being moved off-center.

During pre-launch and in-flight equilibrium, a bearing system constructed in accordance with the present invention allows for relative rotation of a spinning portion of a spin-stabilized projectile with respect to a body portion of such spin-stabilized projectile, referred to herein at times as the "supported despun mass." The complimentary bearing surface interfaces are relatively lightweight and low-drag and facilitate the transfer of radial and axial loads within the projectile and also in the automatic re-centering of the projectile components subsequent to launch in order to quickly reach relative in-flight equilibrium arrangement.

In one embodiment of the present invention, conical mating surfaces are machined into ball bearing races and seat against corresponding complimentary conical mating surfaces on portions fixed with respect to a housing and/or body portion. Separate mating shoulders and/or conical shoulders provide a seat or hard stop for the bearing races adjacent the spindle and/or axle.

In one embodiment of the present invention, one or more pairs of bearing assemblies each include an outer bearing race and a cooperating inner bearing race. The inner bearing races are fixed in place with respect to the spindle and can be integral therewith or attached thereto by fasteners. The inner bearing races extend outward radially and each have a conical surface that is positionable to be in a free-spinning running clearance position with respect to a corresponding cooperating conical surface spaced apart therefrom. Such cooperating conical surface may be integral with or connected to the body portion. Each outer race is urged towards, i.e., pre-loaded against, its cooperating inner race via biasing elements such as spring members. Such pre-loading also biases each outer race towards a respective cooperating conical surface which is integral with or connected to the body portion.

With such configuration, as axial forces in the spindle exceed the spring pre-load provided by such spring members, the spindle may displace axially and force the conical surface portion of the inner race in the leading bearing assembly (leading, here meaning in the sense of the direction of movement of the spindle) towards its cooperating outer race and thus causes such outer race to compress a spring member on the end of the housing toward which the spindle is moving. This spindle movement continues until the conical surface on another inner race of the bearing assembly (trailing, in the direction of the spindle movement) makes contact with its cooperating conical surface of the housing, thereby grounding further axial movement of the spindle in the leading direction. At that point, the now-grounded end of the spindle is constrained against further axial motion, and by virtue of the conical surface, radial movement as well. Additional axial load on the spindle may be supported by the now-mating conical surfaces of a (trailing) inner race and housing, and the bearing load through the ball bearings or other bearing elements of the bearing assemblies will be limited, thereby reducing the potential for deformation of the ball bearings due to overload conditions.

In this condition, the leading end of the spindle may not yet be directly constrained. The constraint there occurs, however, in the presence of radial forces when the spindle moves radially. Under sufficient radial load, the spindle will move radially, in turn pushing the leading-end outer race radially outwardly. If at that time the outer race is still in contact with its cooperating, or mating, conical surface on the housing, such conical surface may redirect the radial motion of the outer race into a combined radial and axial motion. The axial components of the motion of the outer race may cause further compression of the preload spring associated with such outer race. This axial motion may continue until the conical surface on the previously unconstrained "leading" inner race makes contact with its cooperating conical surface of the housing. Accordingly, at this point, further radial loading of the spindle will be transferred into the housing, and the load on the ball bearings or other bearing elements of the leading inner race will be limited to that which is generated by the spring member associated with such leading bearing assembly.

It is to be noted here that the inner and outer race of each bearing assembly are angularly offset with respect to one another in relation to the central axis of the projectile, and the ball bearings angularly transmit the forces between the respective inner and outer races.

Once the loading that caused the spindle to displace subsides, the spring force on the displaced leading outer race will reassert to drive such outer race back into contact with its associated cooperating conical housing surface, thereby re-centering the spindle and re-establishing a running clearance for the bearing assemblies, i.e., free spinning bearing function for the spindle is restored. It should be noted that when the spindle is displaced sufficiently axially or radially, one or both of the inner races are in contact with the outer housing, thereby inhibiting relative rotation of the spindle with respect to the housing or body portion.

The present invention facilitates protection of a projectile's bearings, which may otherwise be overloaded and potentially damaged by gun launch accelerations, by isolating the bearings against overloads in axial and radial directions. This is accomplished, when necessary in an over-load situation, by the bearing assembly components, namely the respective inner and outer races, being displaced against the force of the spring members until contact with strong load-supporting surfaces or stops (such as the cooperating conical surfaces of the housing), at which time further loads are transmitted through the inner bearing races. The present invention may also further include use of spring force from the spring members to accurately re-center the spindle and/or supported mass after an overload condition has subsided. The conical mating surfaces provide kinematically constraining interfaces, or seats, that facilitate the accurate and automatic re-centering of the spindle and/or supported mass. Additionally, the present invention redirects randomly-oriented balloting lateral, or side, loads by use of the conical mating surfaces mentioned above, or similar mating surfaces such as rotatably cooperating nestable concave-convex, curved, and/or parabolic-shaped surfaces, into axial force displacement so that radial springs are not necessary. As used herein, the term "angled," when used to describe surfaces, includes such rotatably cooperating nestable concave-convex, curved, and/or parabolic-shaped surfaces.

A variation of the present invention may include use of standard radial bearings fitted with conical surfaces. In one embodiment of such variant, the grounding, or stop, conical surfaces are separate surfaces from the preloaded loaded conical stop surfaces.

BRIEF DESCRIPTION OF THE DRAWINGS

The drawings referenced herein form a part of the specification. Features shown in the drawings are meant as illustrative of some, but not all, embodiments of the invention, unless otherwise explicitly indicated, and implications to the contrary are otherwise not to be made. Although in the drawings like reference numerals correspond to similar, though not necessarily identical, components and/or features, for the sake of brevity, reference numerals or features having a previously described function may not necessarily be described in connection with other drawings in which such components and/or features appear.

DESCRIPTION OF THE PREFERRED EMBODIMENT

In the following detailed description of representative embodiments of the invention, reference is made to the accompanying drawings that form a part hereof, and in which are shown by way of illustration specific examples of embodiments in which the invention may be practiced. While these embodiments are described in sufficient detail to enable those skilled in the art to practice the invention, it will nevertheless be understood that no limitation of the scope of the present disclosure is thereby intended. Alterations and further modifications of the features illustrated herein, and additional applications of the principles illustrated herein, which would occur to one skilled in the relevant art and having possession of this disclosure, are to be considered within the scope of this disclosure. Specifically, other embodiments may be utilized, and logical, mechanical, electrical, and other changes may be made without departing from the spirit or scope of the present invention.

Accordingly, the following detailed description is not to be taken in a limiting sense, and the scope of the present invention is defined by the appended claims.

Figure 1:
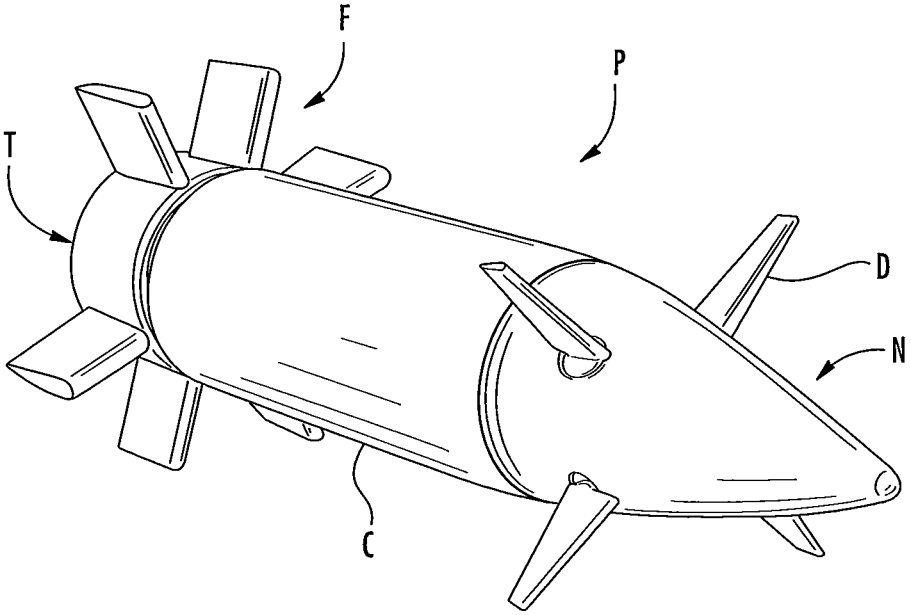
FIG. 1 is a perspective view of a spin-stabilized projectile which may, in one embodiment, be constructed in accordance with the present invention.

FIG. 1 illustrates one potential embodiment of a spin-stabilized projectile, generally P, which incorporates use of a projectile bearing system constructed in accordance with the present invention. It is to be understood, however, that the present invention is not limited to use in connection with such projectile P, but could be used in a variety of other projectile configurations, including without limitation, fin-stabilized projectiles.

Projectile P includes an outer casing, generally C, a forward, or nose, portion, generally N, which may include movable canards, generally D, and a tail section, generally T, having tail canards F. Such projectile P may be of configurations other than that shown in FIG. 1. For example, projectile P may or may not include use of tail canards F, movable canards D, etc. Additionally, projectile P could be rocket-assisted, if desired.

Pre-Launch

Figure 2:
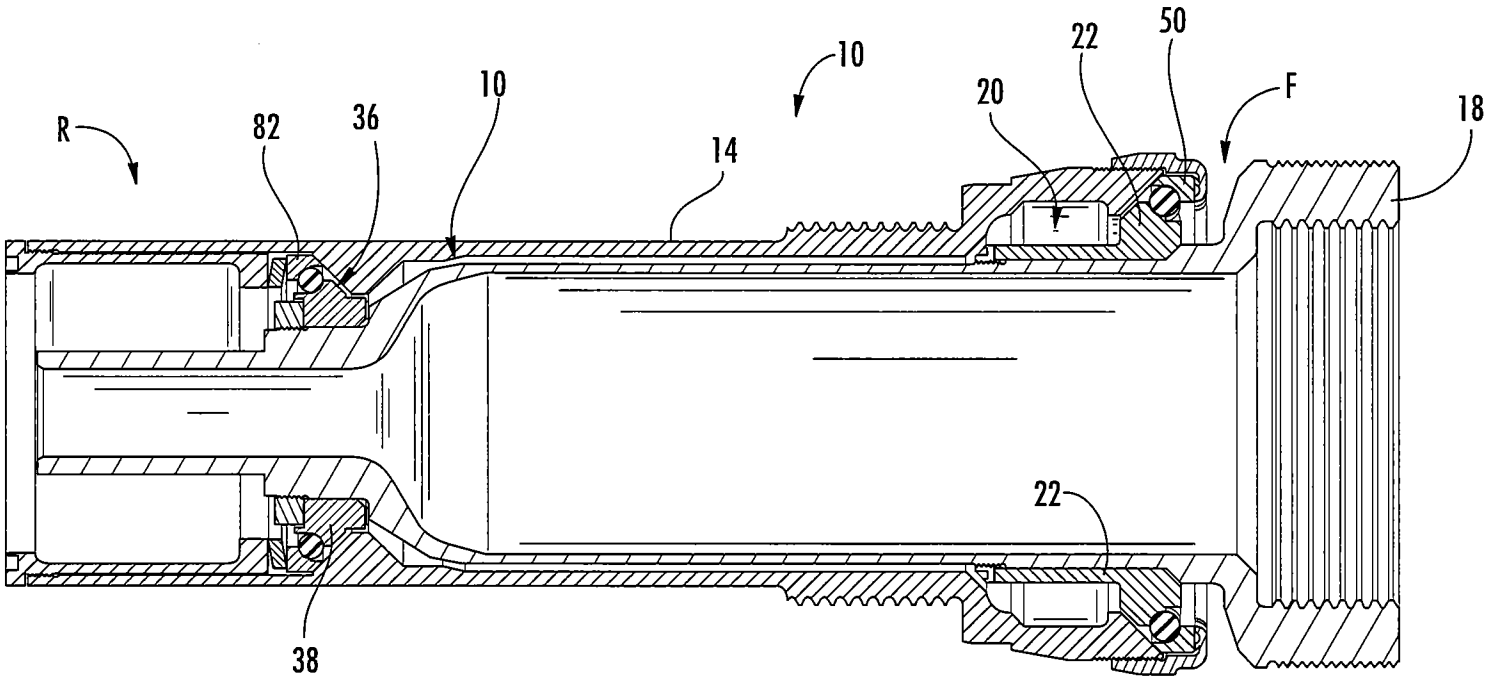
FIG. 2 is a sectional view of a spin-stabilized projectile, such as of the type shown in FIG. 1, and illustrates internal components of such spin-stabilized projectile in an example configuration that may exist prior to launch of such spin-stabilized projectile and after the projectile reaches in-flight equilibrium.
Figure 2A:
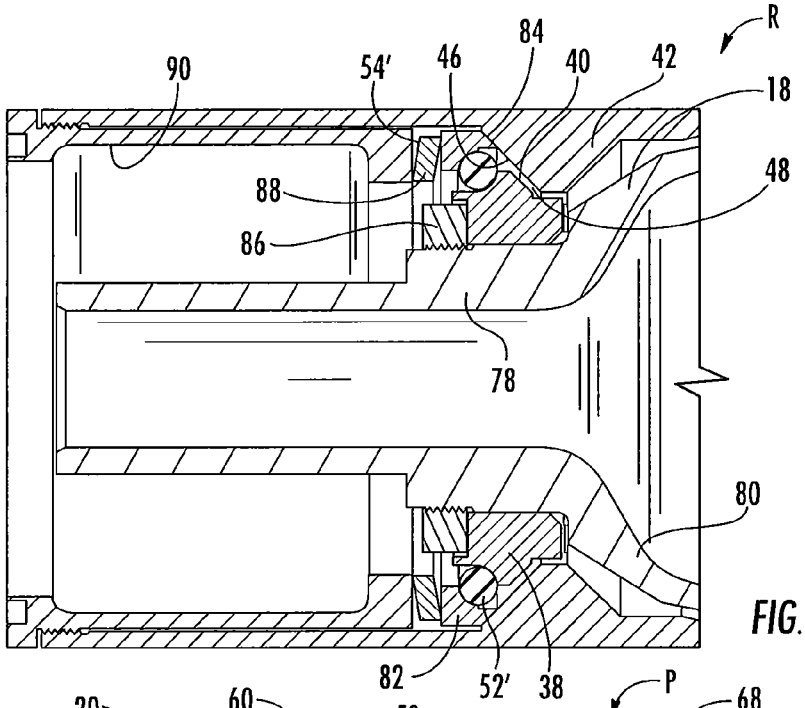
FIG. 2A is an enlarged sectional view of a rearward portion of the projectile shown in FIG. 2.
Figure 2B:
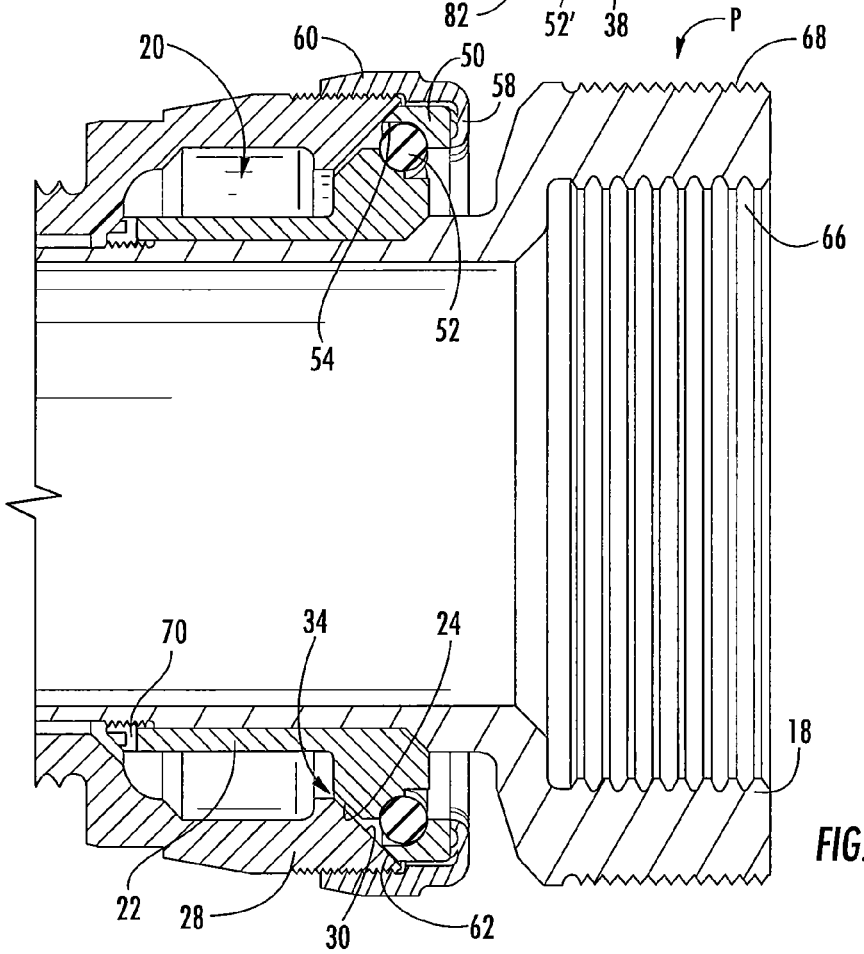
FIG. 2B is an enlarged sectional view of a forward portion of the projectile shown in FIG. 2.

FIGS. 2, 2A, and 2B illustrate one embodiment of a projectile bearing system, generally 10, constructed in accordance with the present invention, within a projectile P. The configuration of system 10 as shown in FIGS. 2, 2A, and 2B is one that may exist prior to launch of projectile P. Such configuration may also be approximated by system 10 within projectile P once projectile P reaches in-flight equilibrium.

Figure 5:
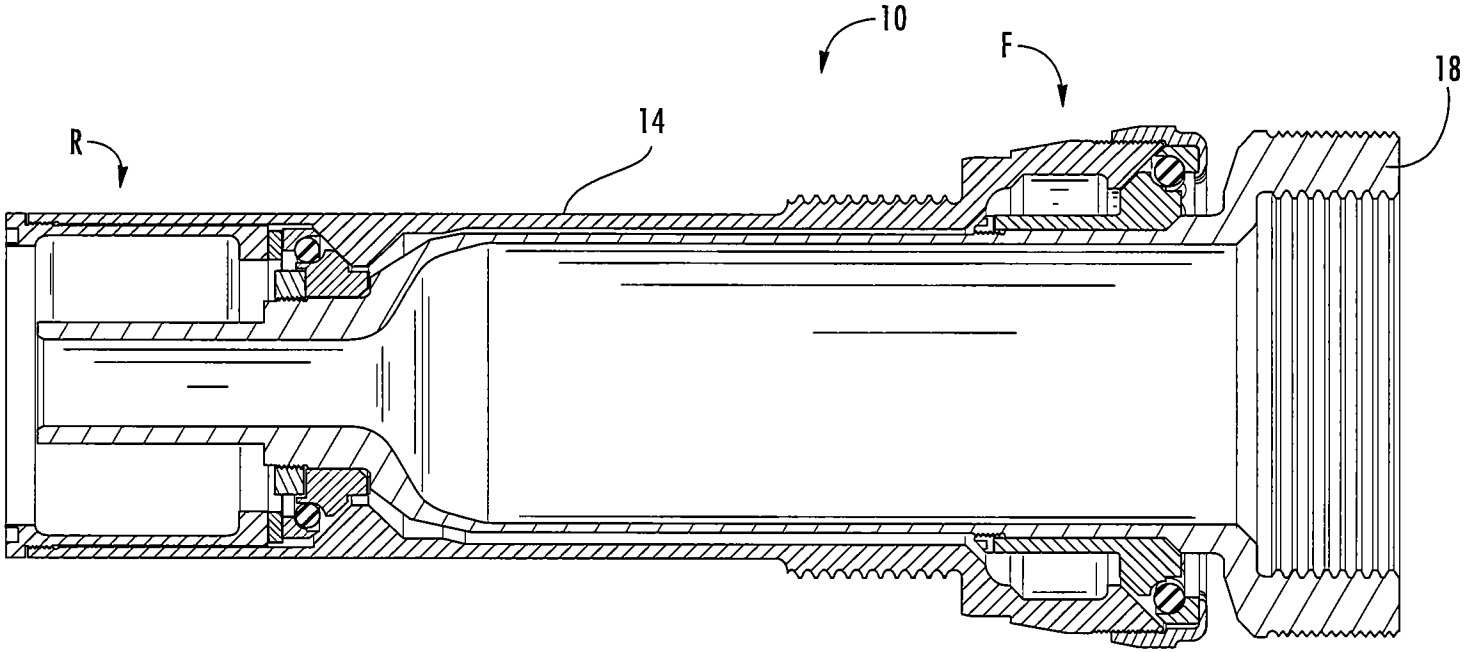
FIG. 5 is a sectional view of a spin-stabilized projectile, such as of the type shown in FIG. 1, and illustrates internal components of such spin-stabilized projectile in an example configuration that may exist during balloting, or, in other words, generally during setback, before set-forward, and/or during set-forward.

Projectile P includes a longitudinally extending body portion, generally 14, within casing C of generally cylindrical configuration oriented about and longitudinally extending central axis, generally CA (FIG. 5). Carried within a body, or housing, portion 14 is a spindle, generally 18. Spindle 18 is configured to rotate about central axis CA with respect to body portion 14 during the flight of projectile P in a manner discussed in more detail below.

A first, or forward, bearing configuration or assembly, generally 20, is carried within the forward portion, generally F, of housing 14 and includes a first, or inner, bearing member, 22. Bearing member 22 defines a first bearing surface 24 which, as illustrated in FIG. 2B extends at an angle with respect to the central axis CA. Bearing member 22 is generally of a ring-shape, and bearing surface 24, due to its angle, results in bearing member 22 defining generally a portion of a cone, i.e., a generally conical profile. Housing 14 includes a circumferentially-extending portion, generally 28, which defines an angled, or conical, surface 30 to matingly compliment the angle of bearing surface 24 such that, as shown in FIGS. 2A and 2B, surfaces 24 and 30 extend in generally parallel relationship with respect to one another and together define a gap 34 therebetween during the pre-launch and in-flight equilibrium configurations of projectile P.

At the rearward portion of housing, generally R, a second bearing configuration or assembly, generally 36, is provided having a second, or inner, bearing member 38, also of a generally ringed-shape and which includes a bearing surface 40, angled with respect to central axis CA, such that surface 40 is conical in profile, i.e., defines generally a cross-section of a cone about the circumference of bearing member 38. Housing 14 includes a circumferential portion 42 in proximity to bearing member 38, and portion 42 defines an angled, or conical, surface 46 matingly complimentary to the surface 40 of bearing member 38, such that surfaces 40 and 46 extend in a generally parallel relationship with respect to one another and define a gap 48 therebetween upon the projectile being in pre-launch and in-flight configurations.

Bearing members 22 and 38 each act as an inner race for bearing assemblies 20 and 36, respectively. Bearing assembly 20 also includes a cooperating member, such as a generally ring-shaped outer race 50 positioned adjacent inner race 22. A plurality of rolling bearing elements, such as ball bearings, generally 52, are carried within a cooperating profile, or raceway, generally 54, circumferentially defined in each of inner race 22 and outer race 50 to allow relative movement of inner race 22 with respect to outer race 50 during certain states of operation of projectile P, such as during pre-launch and in-flight equilibrium. In the case of use of ball-shaped bearings 52, profiles 54 one of a curved or semi-circular cross-section to accommodate the curvature of ball bearing 52. However, if other rolling elements were used, such as cylinders (not shown), then profile 54 would be accordingly configured to accommodate such rolling members.

Attached to the extreme end of housing 14 is a spring-biased element, generally 58, such as a spring and nut combination, which includes a circumferentially-extending skirt portion 60 having a threaded interior portion which threadingly engages with threads about the periphery of the front of housing 14. Spring and nut combination 58 applies an axial spring bias force against outer race 50, forcing outer race 50 towards ball bearings 52 and inner race 22. Outer race 50 also defines a circumferentially-extending face 62 which is angled, or conical, and is complementary to and cooperates with respect to central axis CA. Face 62 is of the same or similar angle as face surface 30 (which is also conical) of inner race 22 and also matingly cooperates with surface 30 of circumferential portion 28.

Spindle 18 includes at its extreme forward end a threaded portion 66 and an exterior threaded portion 68 for carrying nose portion N which, as discussed above, may include in certain embodiments movable canards D and/or other airfoils to allow selective guidance of projectile P during flight. A threaded ring 70 is threadingly attached externally to spindle 18 to hold bearing member 22 in place. Bearing member 22 could be made integral to spindle 18, if desired, in which case a separate threaded ring 70 could be eliminated.

At the rearward portion R of housing 14, inner race 38, as noted above, is ring-shaped and encircles a neck portion 78 of spindle 18 adjacent a shoulder 80. Bearing assembly 36 may include a cooperating member, such as a ring-shaped outer race, generally 82, is provided in cooperation with inner race 38 and defines a raceway, generally 54', for rolling bearing elements, such as ball bearings 52'. Each inner race 38 and outer race 82 defines a cooperating profile for receipt of ball bearings 52, although, as discussed above with respect to bearing assembly 20, such profile could be varied depending on the type of rolling bearing element used.

Outer race 82 includes a circumferentially-extending angled, or conical, surface, or face, 84 of the same or similar cooperating angle as surface or face 40 of inner race 38. Outer race face 84 is also conical and cooperates with angled surface 46 of housing circumferential portion 42 and maintains contact with angled surface 46 during certain configurations of projectile P, such as when projectile P is in the pre-launch and in-flight equilibrium configurations. A ring 86, fastened by thread or other manner, bears against inner race 38 to hold it in place about neck portion 78 of spindle 18. A spring-biased element, generally 88, such as a spring washer, which could include a Belleville washer, biases outer race 82 towards surface 46, ball bearings 52, and inner race 38. A threaded sleeve, or nut, generally 90, is threadingly inserted into housing 14 and is used to adjustably preload spring 88.

In the pre-launch configuration, a pre-load is provided by spring-biased elements 58 and 88 together with bearing assemblies 20 and 36, that maintains spindle 18 centered in the pre-launch configuration. Upon experiencing a certain load, spindle 18 tends to move such that the load paths it experiences change, and, accordingly, bearing assemblies 20 and 36 are protected from being overloaded. As discussed above, lateral or side loads are redirected so that they are ultimately accommodated by the body portion 14 and spring members 58, 88.

Turning to the equilibrium condition, spindle 18 is free to spin, and inner races 22, 38 run on ball bearings 52, 52' since there are running clearances with respect to the conical stop surfaces 30, 46. In this manner, as discussed above, the hard stop that surface 30 provides to inner race 22 reduces additional force being transmitted to ball bearing 52, thereby reducing the potential of deformation of ball bearing 52.

Set-Back

Figure 3:
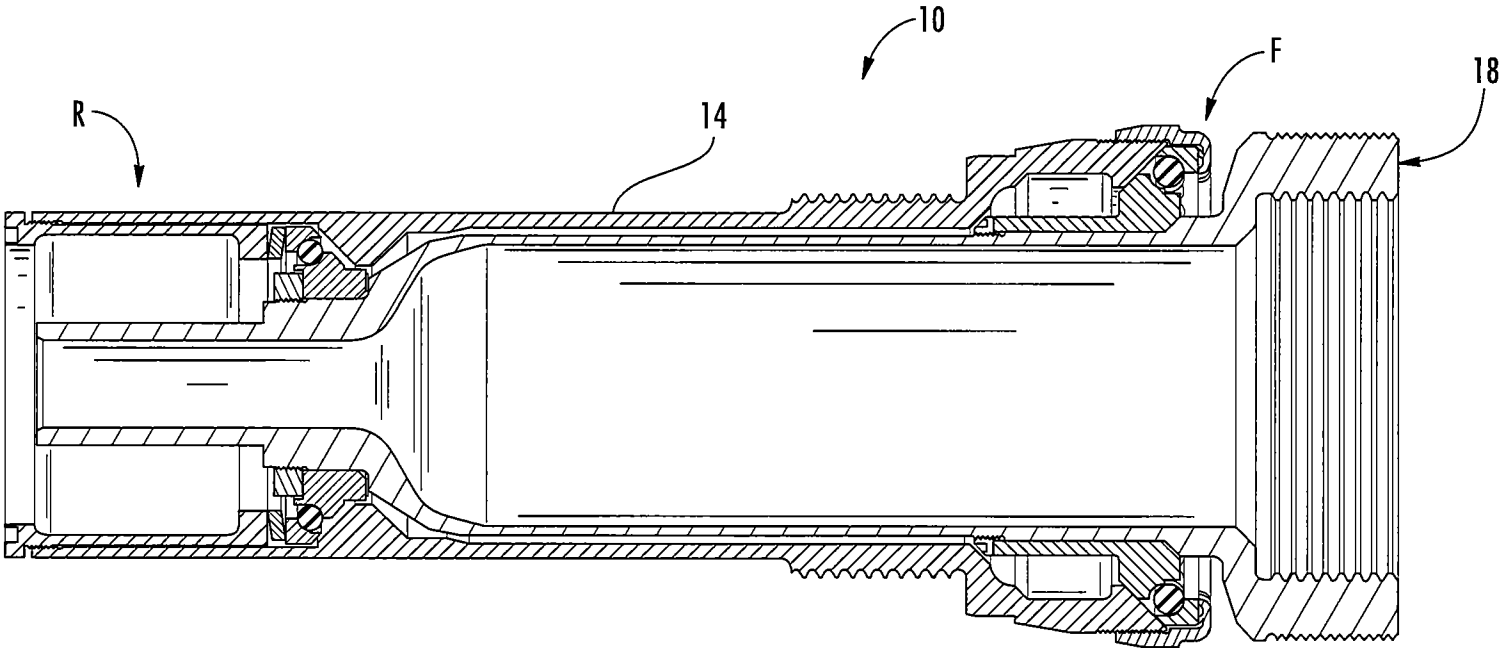
FIG. 3 is a sectional view of a spin-stabilized projectile, such as of the type shown in FIG. 1, and illustrates internal components of such spin-stabilized projectile in an example configuration that may exist during set-back, or, in other words, generally during launch and/or after set-forward events of such spin-stabilized projectile.
Figure 3A:
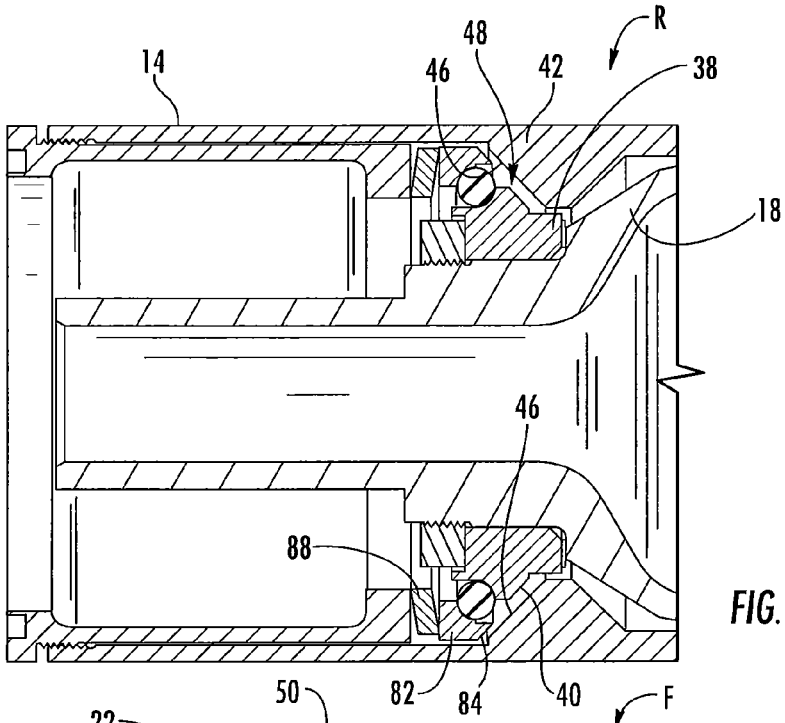
FIG. 3A is an enlarged sectional view of a rearward portion of the projectile shown in FIG. 3.
Figure 3B:
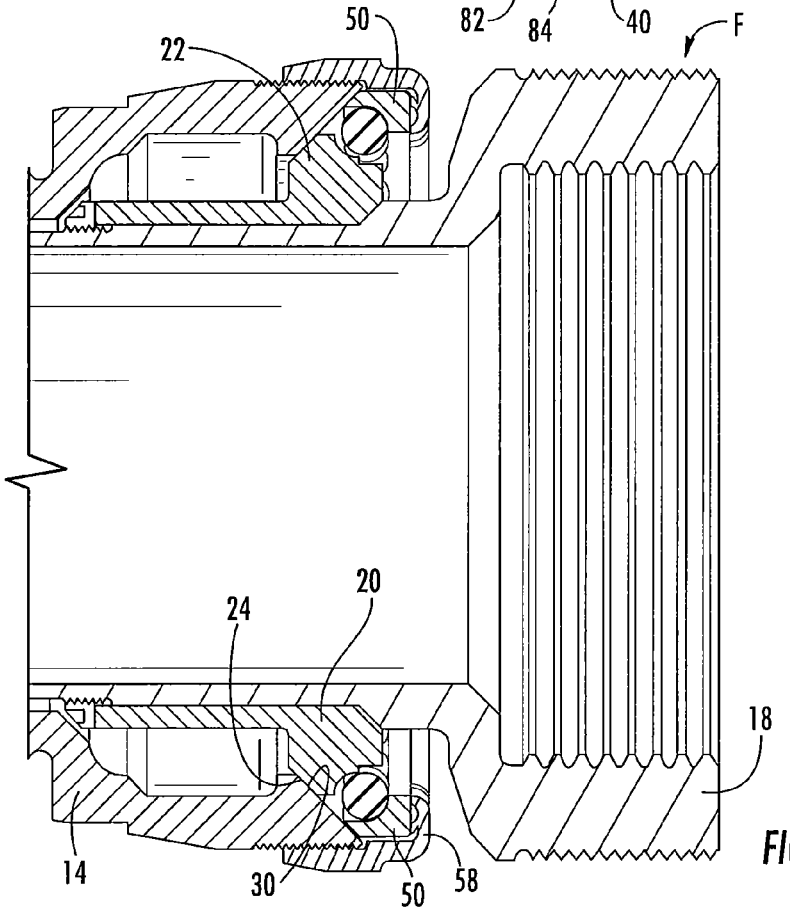
FIG. 3B is an enlarged sectional view of a forward portion of the projectile shown in FIG. 3.

Turning to FIGS. 3, 3A and 3B, system 10 is illustrated in a configuration which it may assume during set-back, during the launch of projectile P. FIG. 3A illustrates the rearward portion R of projectile P, and FIG. 3B illustrates the forward portion of projectile P.

During set-back, internal components within body portion 14 of projectile P tend to resist motion and shift rearwardly relative to body portion 14 as projectile P experiences forward motion in a launch barrel (not shown), which could be rifled or smooth bore, upon being subjected to acceleration forces due to a launch. Once the set-back loads become greater than the pre-load on spring element 88, spindle 18 moves rearwardly (to the left as shown in FIGS. 3, 3A, and 3B). During set-back, spindle 18 tends to move rearwardly, and forward inner race 22 is thus axially displaced rearwardly with respect to outer race 50 (which is abutting surface 30) (FIG. 3B) as spindle 18 moves back to the extent that gap clearance 34 allows. Inner race surface 24 will ultimately make contact with surface 30. However, rear inner race 38 is allowed to move rearwardly. As rear inner race 38 moves rearwardly, it pushes against rear ball bearings 52', which, in turn, push against rear outer race 82. And, outer race 82 moves rearwardly to the extent it overcomes the spring force of spring element 88.

Thus, rear inner race 38 bears against ball bearings 52, which bear against the rear outer race 82, which bears against spring element 88, which bears against the threaded ring which bears against the threaded end member 90.

With continued rearward movement of front inner race 22, and its potential bottoming out against surface 30, as shown in FIG. 3B, gap 48 in the rear bearing assembly 36 between surface 46 and surface 84 increases.

Set-Forward

Figure 4:
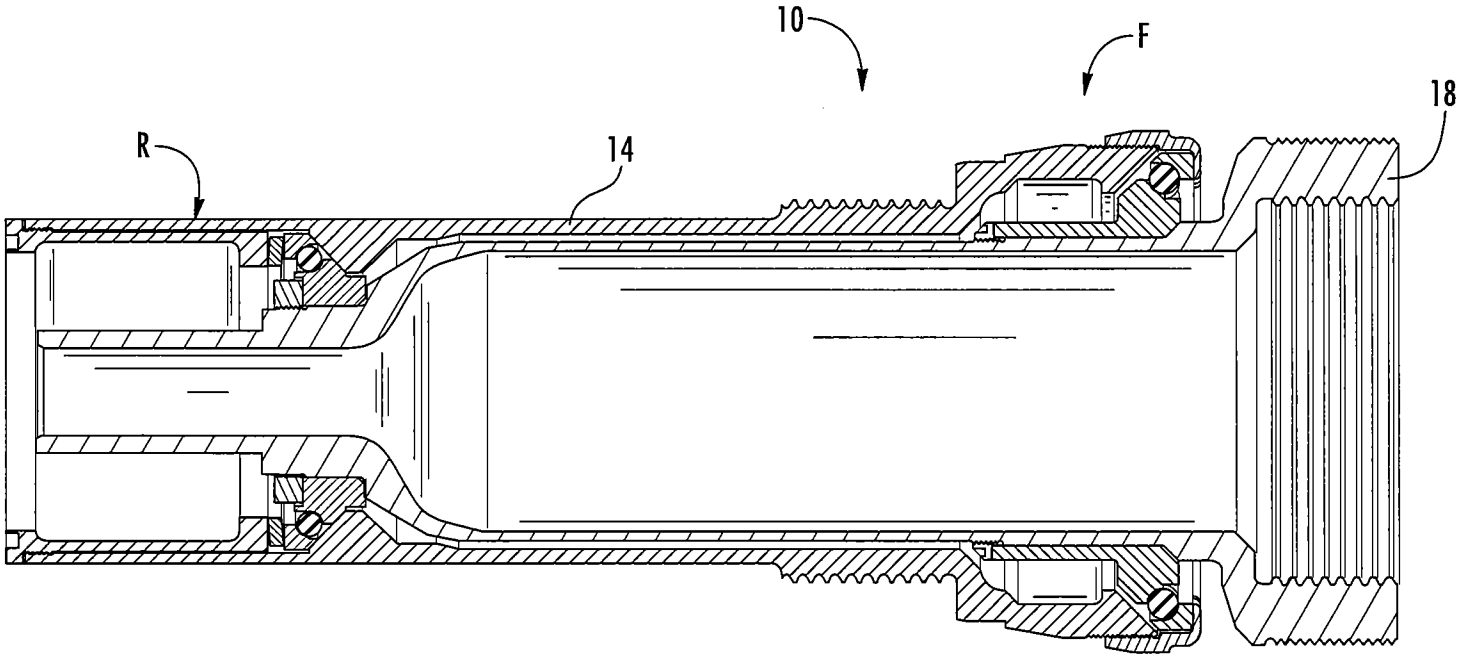
FIG. 4 is a sectional view of a spin-stabilized projectile, such as of the type shown in FIG. 1, and illustrates internal components of such spin-stabilized projectile in an example configuration that may exist during set-forward, or, in other words, generally immediately and/or shortly after set-back and/or perhaps transitionally during set-back and/or balloting of such spin-stabilized projectile.
Figure 4A:
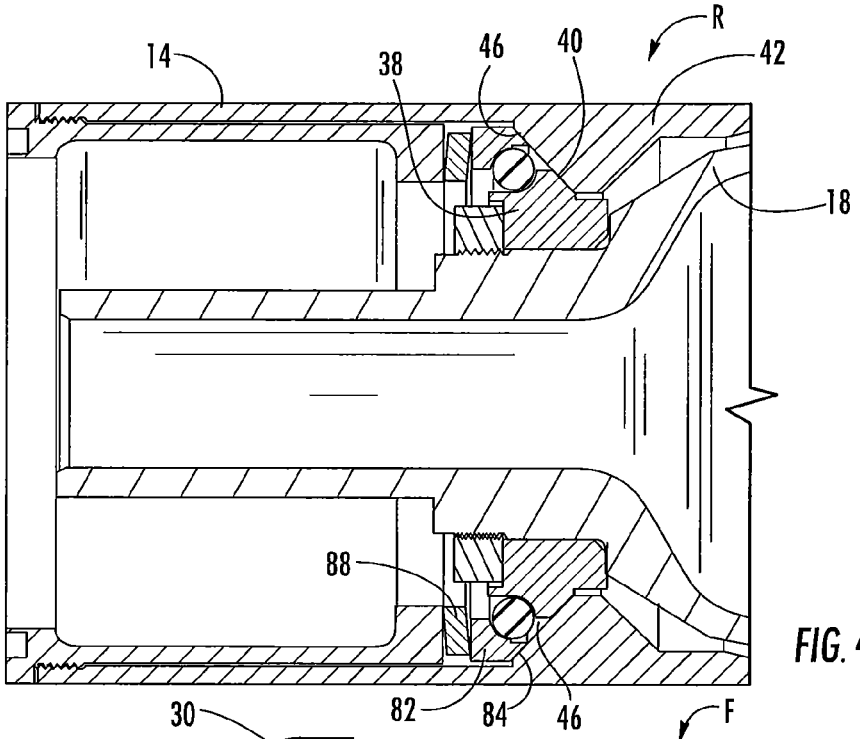
FIG. 4A is an enlarged sectional view of a rearward portion of the projectile shown in FIG. 4.
Figure 4B:
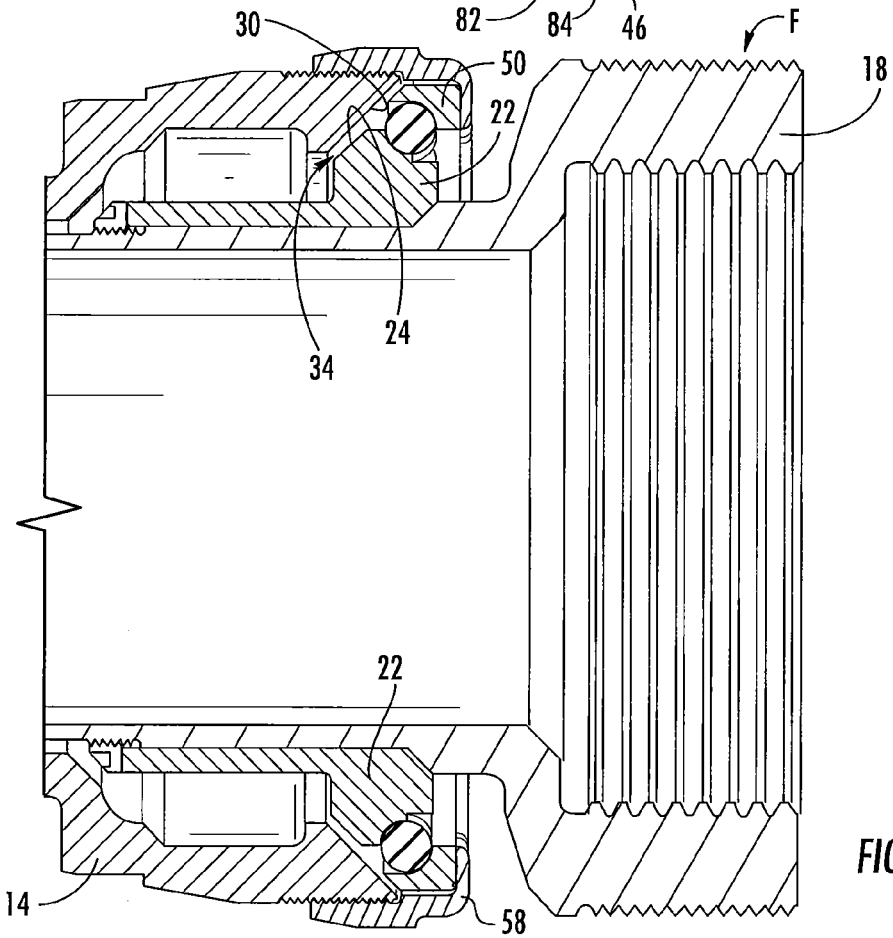
FIG. 4B is an enlarged sectional view of a forward portion of the projectile shown in FIG. 4.

FIGS. 4, 4A, and 4B illustrate a configuration system 10 may assume during set-forward after launch of projectile P, or, in other words, generally after set-back and/or balloting of projectile P. FIG. 4A illustrates enlarged rearward portion R of projectile P, and FIG. 4B illustrates the forward portion of projectile P.

During set-forward, the internal components within body portion 14 of projectile P tend to rebound and move forward relative to the body portion 14. As set-forward forces rise, spindle 18 and bearing assemblies 20, 36 move forward, assisted by the force provided by spring 88, and inner race 22 moves forwardly (to the right as shown in FIGS. 4, 4A, and 4B), ultimately contacting ball bearings 52 and forcing them against outer race 50, against the force of spring member 58. As inner race 22 moves in the forward direction, gap 34 between surfaces 30 and 24 widens (FIG. 4B), and gap 46 in the rear bearing assembly 36 narrows and may ultimately close completely, such that surface 40 of inner race 38 contacts surface 46 of portion 42 (FIG. 4A).

Balloting

Figure 5A:
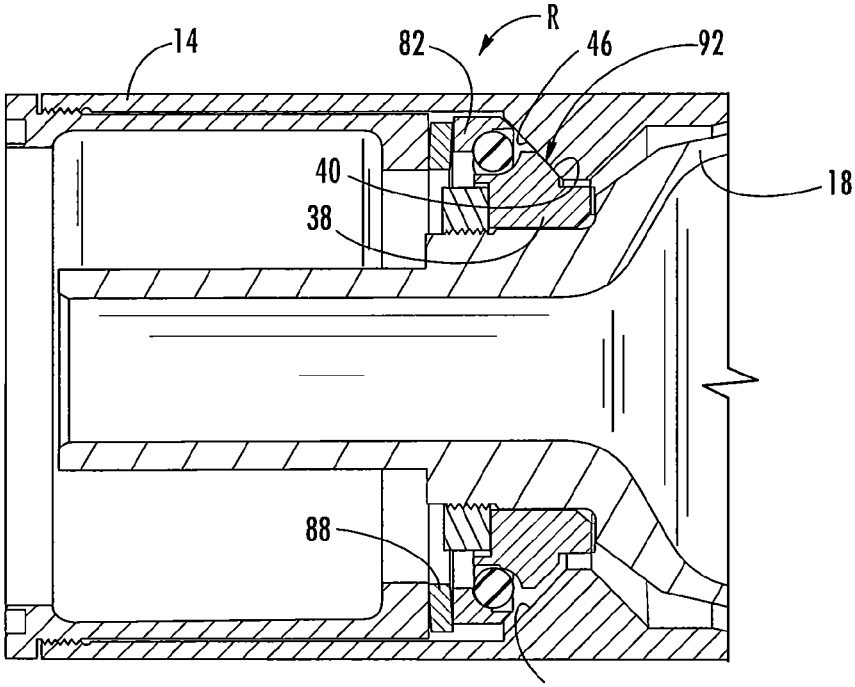
FIG. 5A is an enlarged sectional view of a rearward portion of the projectile shown in FIG. 5.
Figure 5B:
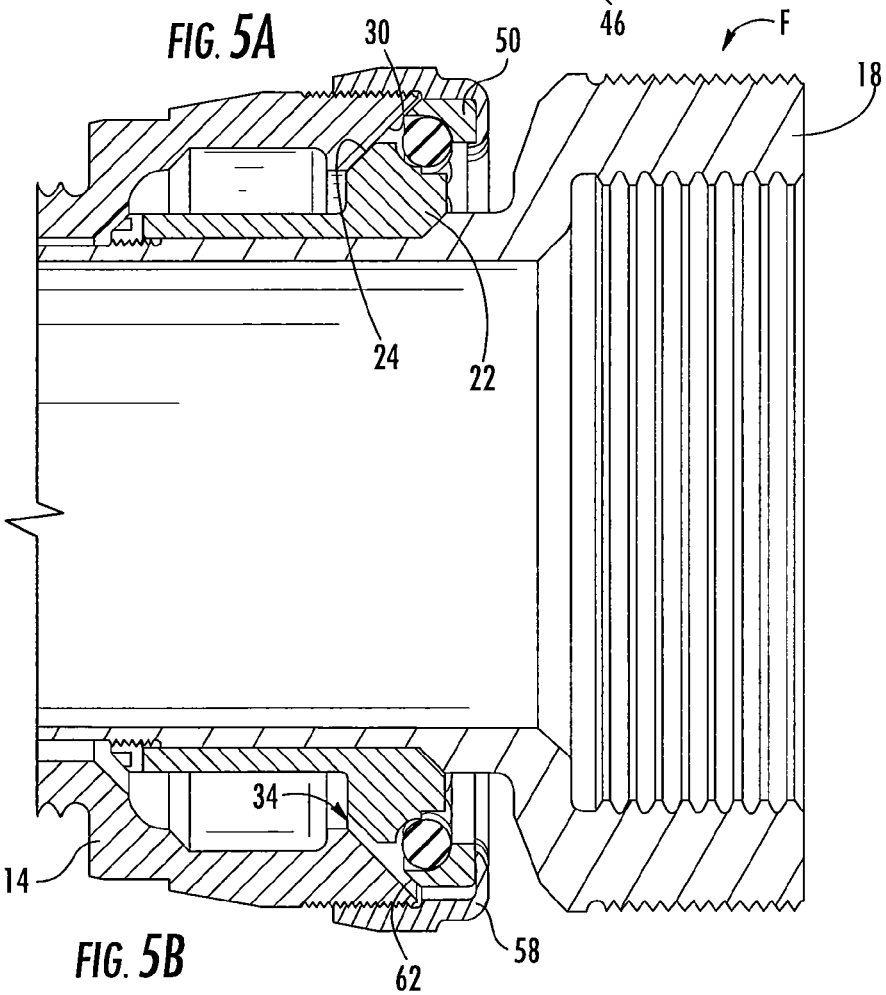
FIG. 5B is an enlarged sectional view of a forward portion of the projectile shown in FIG. 5.

FIGS. 5, 5A, and 5B illustrate a configuration that system 10 may assume during balloting, or, in other words, generally during setback, prior to set-forward, and/or during set-forward of projectile P. FIG. 5A illustrates the rearward portion R of projectile P, and FIG. 5B illustrates the forward portion of projectile P.

Balloting forces may be induced to projectile P as it moves longitudinally down the launch barrel, and such forces may be in addition to set-back forces and/or set-forward forces. Simultaneously as projectile P moves longitudinally down the launch barrel, it may also move laterally back and forth, bouncing off of the interior of the launch barrel. Balloting forces may also be induced to projectile P by the forces of gases exiting the launch barrel around projectile P as it leaves the barrel. When projectile P experiences balloting forces, stop surface 30 may already be in contact with the surface, or face, 24 of inner race 22 (FIG. 5B), thereby permitting the balloting loads to be supported directly in the front bearing assembly 20 without further loading ball bearings 52.

In the rear, gap 48 is created between the inner race 38 and the conical surface 46. Should the rear of spindle 18 move radially outward, for example in the upward direction as shown in FIGS. 5, 5A, and 5B, inner race 38 correspondingly is moved upward until gap 48 is closed, at least over a portion of surfaces 40 and 46, by such radial movement (FIG. 5A), such that there is mechanical contact between surfaces 40 and 46. In this configuration, inner race 38 is slightly axially displaced from outer race 82. This mechanical contact 92 permits the forces from spindle 18 to be transmitted to body portion 14 and spring member 88. Note in FIG. 5A that the portion of gap 48 generally diametrically opposed to the mechanical contact 92 remains open. While FIGS. 5, 5A, and 5B illustrate one view of the effects of balloting forces on projectile P at a particular instance, such configuration is for illustrative purposes only, and projectile P could take on a number of other configurations responsive to balloting forces.

Axial motion of spindle 18 during balloting may open portions of gap 48, and radial movement of spindle 18 in random radial directions may close portions of gap 48 in the direction of such radial movement. In order to do that, inner race 38 pushes upward and diagonally on ball bearings 52. Accordingly, the forces generated by the radial movement of spindle 18 move the inner race 38 upward or downward (with respect to FIGS. 5, 5A, and 5B) due to outer race 82 moving off of stop surface 46, thereby compressing spring member 88. Gap 48 is configured to close readily, such that balloting forces may further push inner race 38 outward on conical stop surface 46 (which further compresses spring member 88 due to the corresponding axial component of the movement of outer race 82), which thus causes outer race 82 to move upwardly in a diagonal manner against stop surface 46. In other words, since outer race 82 is bearing against an angled, or conical, surface 46, as outer race 82 gets driven radially, because of the ramp effect of the conical surface 46, outer race 82 also gets driven to the rear axially and compresses the spring member 88 ultimately until front inner race 22 moves upwardly against the force of spring member 58 (acting through contact of inner race 22 with outer race 50) to contact conical stop surface 30 (FIG. 5B), thereby achieving a rigid mechanical stop and limiting further overloading on the ball bearings 52, 52'.

It is noted that inner races 22, 38 and outer races 50, 82 can, respectively (since they are not mechanically linked to one another), move both radially and axially relative to one another, by virtue of spherical shape of ball bearing 52, 52' respectively interposed therebetween.

In-Flight Equilibrium

Figure 6:
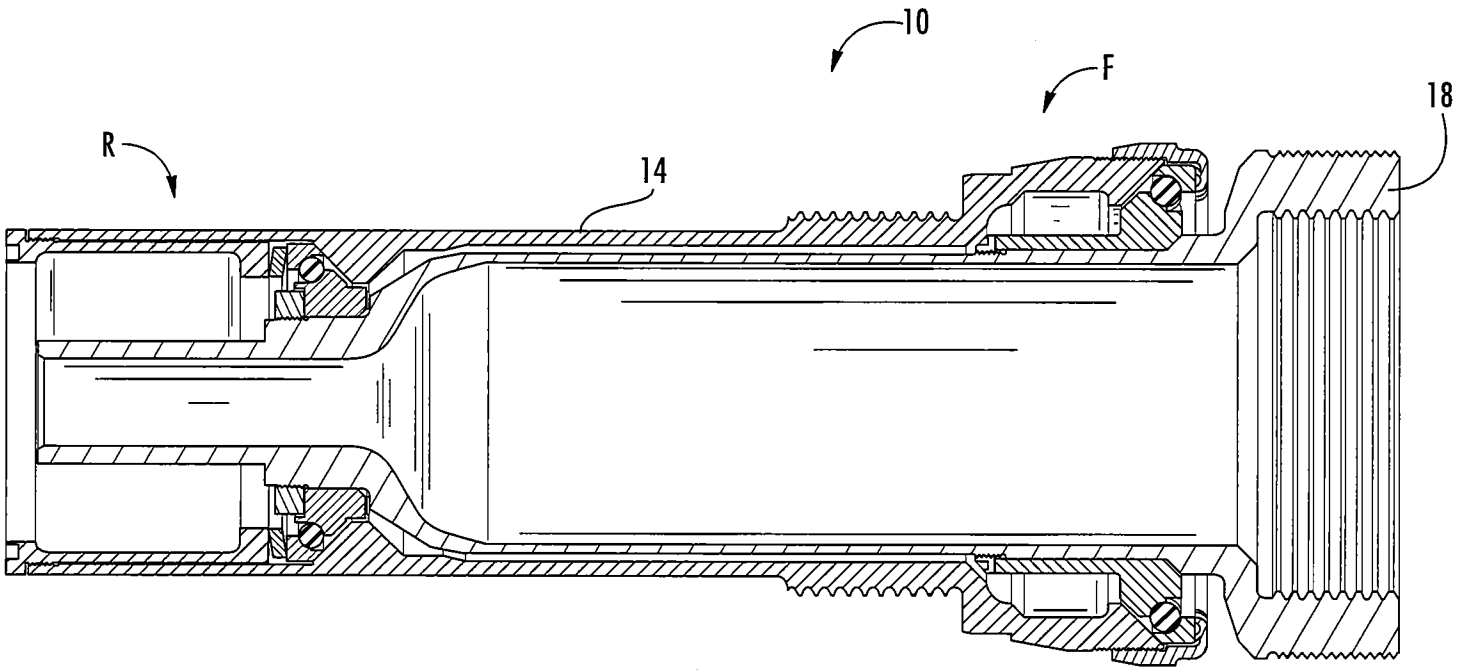
FIG. 6 is a sectional view of a spin-stabilized projectile, such as of the type shown in FIG. 1, and illustrates internal components of such spin-stabilized projectile in an example configuration that may exist during in-flight equilibrium of such spin-stabilized projectile.
Figure 6A:
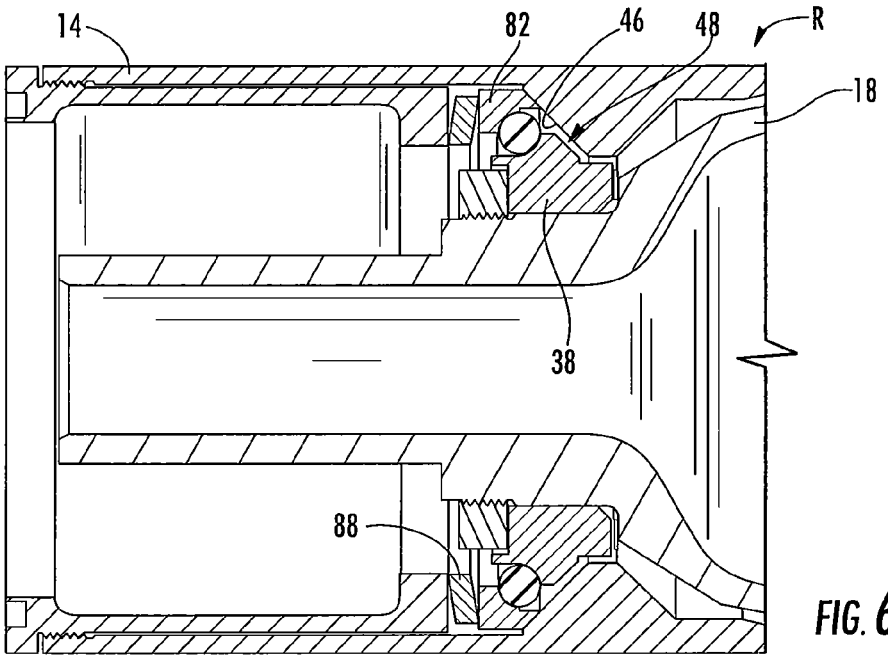
FIG. 6A is an enlarged sectional view of a rearward portion of the projectile shown in FIG. 6.
Figure 6B:
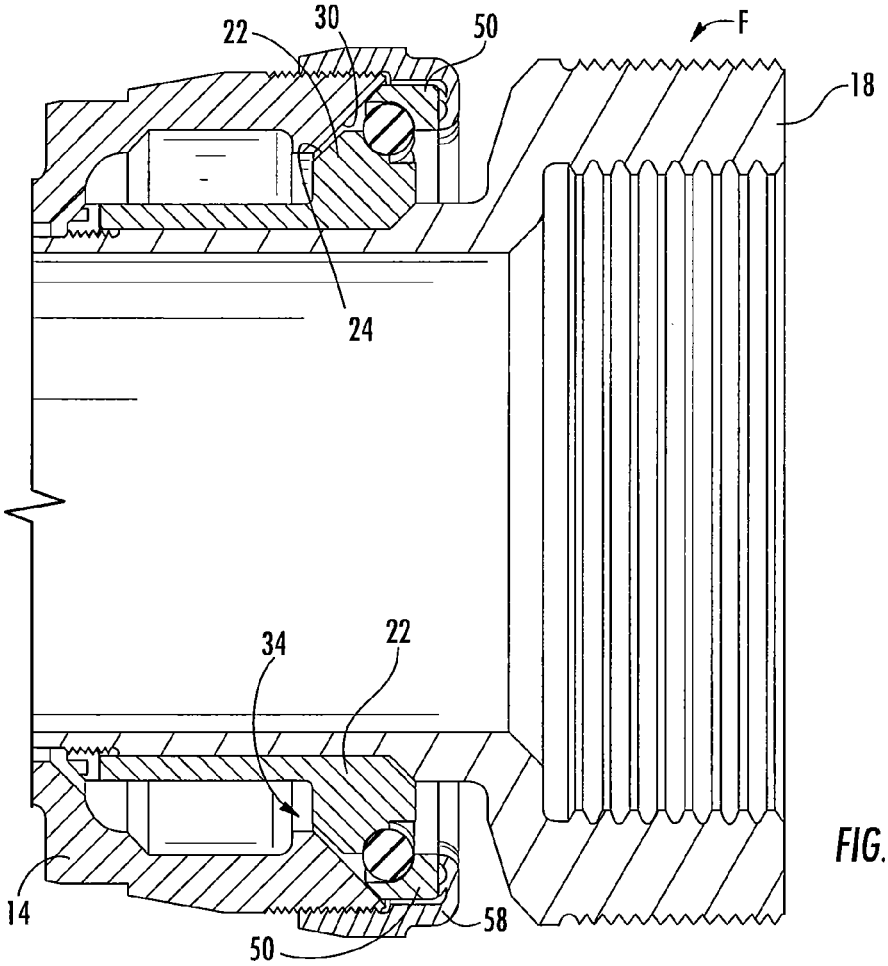
FIG. 6B is an enlarged sectional view of a forward portion of the projectile shown in FIG. 6.

FIGS. 6, 6A, and 6B illustrate a configuration system 10 may assume during in-flight equilibrium of projectile P. FIG. 6A illustrates the rearward portion R of projectile P, and FIG. 6B illustrates the forward portion of projectile P.

Once the high-load condition on spindle 18 dissipates, spring members 58, 88 act to automatically force outer races 50, 82 back to center about central axis CA and to re-seat on the conical surfaces 30, 46 respectively. Spindle 18 thus essentially returns to its pre-launch configuration discussed above in its equilibrium running configuration, wherein front and rear inner races 22, 38 are running on ball bearings 52, 52', respectively, with a running clearance being provided via gaps 34 and 48, respectively. Accordingly, spindle 18 is free to spin with respect to body 14 in the in-flight equilibrium configuration. And, as long as the in-flight loads do not exceed the spring pre-loads of spring elements 58, 88, then inner races 22, 38 and outer races 50, 82 should remain centered. While in-flight, spindle 18 may be selectively de-spun relative to body 14.

Alternate Embodiment

Figure 7:
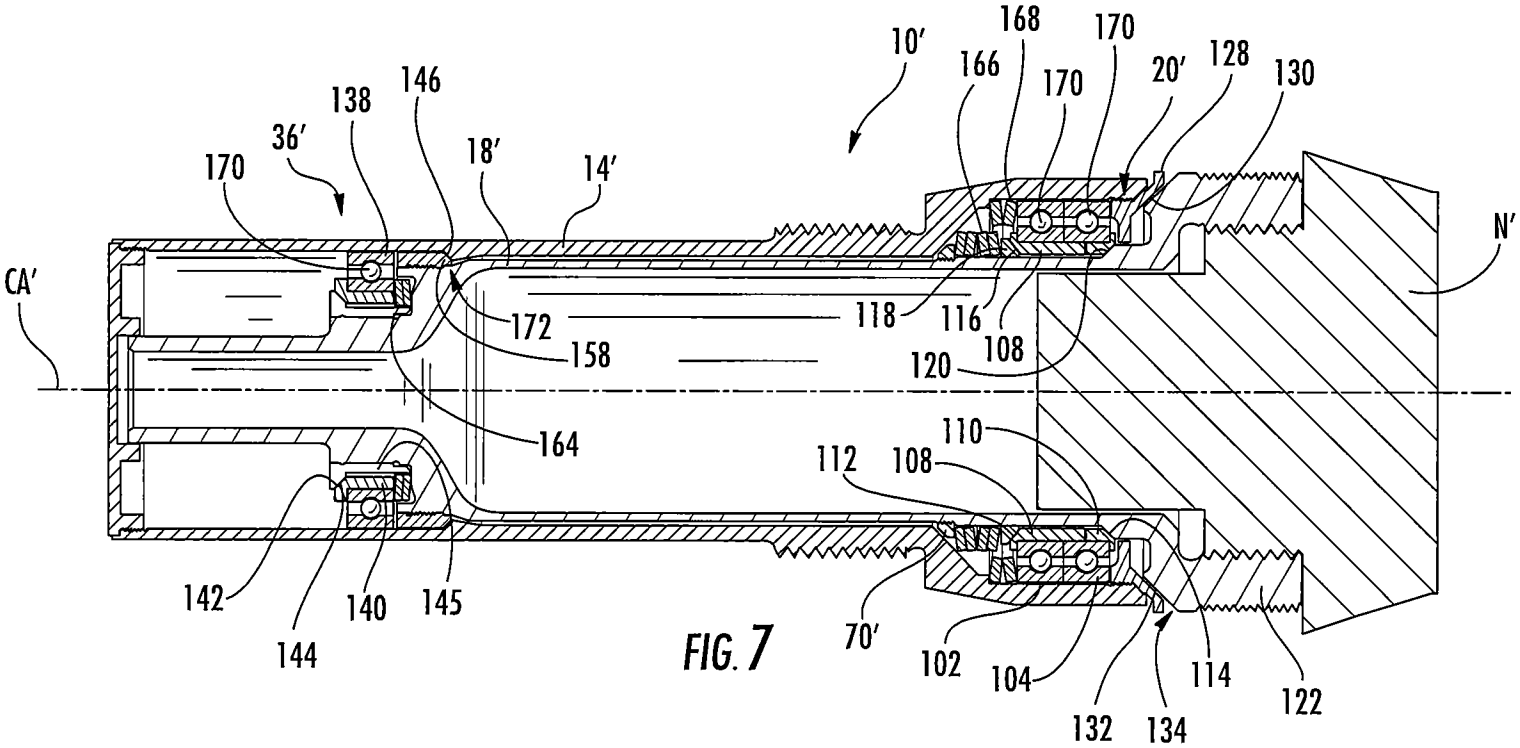
FIG. 7 is a sectional view of another embodiment of a spin-stabilized projectile constructed in accordance with the present invention and illustrates internal components of such spin-stabilized projectile in an example configuration that may exist during in-flight equilibrium of such spin-stabilized projectile.

As shown in FIG. 7, another embodiment of a spin-stabilized projectile constructed in accordance may include a different arrangement of components to form a system 10', such embodiment being shown in FIG. 7 in a configuration that could be pre-launch or in-flight equilibrium.

System 10' includes projectile P having a longitudinally extending body portion, generally 14', and nose portion N'. Carried within body portion 14' is spindle 18'.

A forward bearing configuration or assembly, generally 20', is carried within the forward portion of housing 14' and includes one or more generally ring-shaped ball bearing assemblies, generally 102, 104, which could be conventional ball bearing rings, if desired. A sleeve or bearing element 108 is provided adjacent bearing assemblies 102, 104, and a ring-shaped element 110 is provided adjacent bearing assembly 104. Bearing element 108 includes a circumferentially-extending angled, or conical, surface 112, and bearing element 110 includes a circumferentially-extending angled, or conical, surface 114. A circumferentially-extending angled, or conical, surface 116 is provided on a portion 118 that encircles spindle 18' and cooperates with angled surface 112, and a circumferentially-extending angled, or conical, surface 120 is provided on a portion of spindle 18' that cooperates with angled surface 114 of bearing element 110. Surface 120 of system 10' is similar in operation to first engagement surface 30 of system 10 discussed above.

Another ring-shaped element 128 is integral with or fixedly attached to body portion 14' and includes a circumferentially-extending angled surface 130. Spindle 18' includes a circumferentially-extending angled surface 132 that cooperates with surface 130 to define a running clearance, or gap 134, therebetween when projectile P is in the pre-launch and in-flight equilibrium configurations.

At the rearward portion of projectile P, a rearward bearing configuration or assembly, generally 36', also includes one or more generally ring-shaped ball bearing assemblies, generally 138, which could also be of conventional design. Sleeve element 140 is provided adjacent bearing assembly 138 and includes a circumferentially-extending angled, or conical, surface 142, which cooperates with a circumferentially-extending angled, or conical, surface 144 of a sleeve element 145.

A circumferentially-extending angled, or conical, surface 146 is provided on a ring-shaped member 154 fixed to spindle 18'. Surface 146 cooperates with a circumferentially-extending angled, or conical, surface 158 on body member 14'.

Biasing elements, such as spring members 164, 166, and 168, which could be spring and/or Belleville washers or some other suitable spring elements, apply a pre-load force on spindle 18' to (together with the circumferentially-extending angled surfaces 130, 132, 114, 120, 116, 112, 146, 158, 142, and 144) center spindle 18' within body member 14' with respect to central axis CA' and to automatically re-center spindle 18' about central axis CA' in the event spindle 18' moves off-center during launch, set-back, balloting, set-forward and/or in-flight equilibrium. System 10' functions similarly to system 10 discussed above to prevent ball bearings 170 and/or bearing assemblies 102, 104, and 138 from becoming overloaded and to also automatically maintain spindle 18' centered about central axis CA'.

During set-back, gap 134 closes as spindle 18' moves rearwardly (to the left, as shown in FIG. 7) against the force of spring member 168 such that angled surface 130 provides a hard stop for spindle 18' via angled surface 132 of element 128, which facilitates a reduction in additional forces being applied to bearing assemblies 102 and 104. The outer race of bearing assembly 138 is free to move axially so bearing assembly 138 is substantially not loaded in set-back or set forward. In equilibrium and set-back, forces from spring member 166 keeps surfaces 116, 112, 120, and 114 in contact.

During set-forward, spindle 18' moves forward, and threaded ring 70' moves with spindle 18'. Bearing assembly 20' is prevented from moving forward by element 128. However, springs 166 give latitude to allowing spindle 18' to move forward relative to bearing assembly 20' due to contact and interaction of ring 70' with springs 166. Surfaces 112 and 116 remain in contact, but a gap forms at surfaces 114 and 120.

During radial displacement of spindle 18', surface 120 correspondingly moves radially, causing bearing assembly 20' and element 108 to move axially rearwardly (to the left, as shown in FIG. 7) to compress springs 166, due to the ramp effect at the interface of angled surfaces 114 and 120 providing an axial movement component. Component 108 moves rearward pushing portion 118 against biasing elements 166. Balloting forces on the rear bearing assembly 138 cause forward axial motion of sleeve element 140 (and its bearing) against the force of spring member 164 driven by the wedging action of contacting angled surfaces 142 and 144. Radial motion of spindle 18' continues until surface 146 and 158 make contact with one another.

During set-forward, gap 172 between angled surfaces 146 and 158 closes as spindle 18' moves forward (to the right, as shown in FIG. 7) against the force of spring member 166 such that angled surface 158 provides a hard stop for spindle 18' via angled surface 146. Balloting forces are also redirected against the force of spring members 166 and 168 in the axial and radial directions via the ramp-effect discussed above provided by angled surface pairs 146, 158 and 130, 132.

Upon overload conditions subsiding, the angled surfaces 130, 132, 114, 120, 116, 112, 146, 158, 142, and 144 serve to the aid spring members 164, 166, and 168 in the automatic re-centering and the maintenance of centering of spindle 18'.

In system 10', the inner and outer races of bearing assemblies 102, 104, and 138 are mechanically linked to one another. Thus, such inner and outer races race cannot move both radially and axially with respect to one another. As noted above, because they are not mechanically linked to one another, inner races 22, 38 and outer races 50, 82 can, respectively, move both radially and axially relative to one another, because of the ball bearing interface respectively therebetween. Springs 168 are provided in system 10' to help accommodate a lack of a degree of freedom of movement of bearing assemblies 20' and 36' as compared to bearing assemblies 20, 36 of system 10.

Accordingly, the present invention thus provides a relatively simple and lightweight arrangement for the nose and/or tail section in a spin-stabilized and/or fin-stabilized projectile to protect lightweight, low-drag bearings against large gun launch loads, while providing accurate and automatic in-flight centering of the supported spindle and/or rotating mass.

While several representative embodiments have been described in detail herein, it will be apparent to those skilled in the art that the disclosed embodiments may be modified and/or tailored for particular applications or circumstances. Therefore, the foregoing description is to be considered as describing examples of embodiments implementing the present invention and is not intended to limit the present invention to these embodiments. On the contrary, the present invention is intended to cover alternatives, modifications and equivalents, which may be included within the spirit and scope of the invention as defined by the appended claims.

Furthermore, in the detailed description of the present invention, numerous specific details are set forth in order to provide a thorough understanding of the present invention. In other instances, well-known methods, procedures, components, arrangements, and configurations have not been described in detail as not to unnecessarily obscure aspects of the present invention. However, it will be recognized by one of ordinary skill in the art that the present invention may be practiced without these specific details.

What is claimed is:

1. A bearing system for a projectile having a longitudinally extending body portion with a forward portion and a rearward portion and a spindle generally defining a central axis, the projectile being subject to pre-launch, launch, set-back, set-forward, balloting, and in-flight forces, the bearing system comprising:

a first bearing configuration having a first member;

a second bearing configuration having a second member;

said first bearing configuration and said second bearing configuration being configured to permit selective relative rotation between said body portion and said spindle about said central axis;

said first member defining a first bearing surface extending at an acute first angle with respect to said central axis;

a first engagement portion fixed relative to said body portion defining a first engagement surface extending at an angle substantially parallel to said first angle of said first bearing surface;

said second member defining a second bearing surface extending at an obtuse second angle with respect to said central axis;

a second engagement portion fixed relative to said body portion defining a second engagement surface extending at an angle substantially parallel to said second angle of said second bearing surface;

said first bearing surface being configured to engage said first engagement surface upon the projectile experiencing set-back forces;

said first bearing surface being configured to be substantially disengaged from said first engagement surface upon said projectile experiencing set-forward forces;

said second bearing surface being configured to be substantially disengaged from said second engagement surface upon said projectile experiencing set-back forces; and said second bearing surface being configured to engage said second engagement surface upon the projectile experiencing set-forward forces.

2. The bearing system as defined in claim 1, wherein:

said first bearing configuration is proximate the forward portion of the body portion; and said second bearing configuration is proximate the rearward portion of the body portion.

3. The bearing system as defined in claim 1, further comprising:

a first biasing element that generally axially biases said first cooperating member towards said first member; and a second biasing element that generally axially biases said second cooperating member towards said second member.

4. The bearing system as defined in claim 1, wherein at least one of said first bearing surface and said first engagement surface is conical.

5. The bearing system as defined in claim 1, wherein at least one of said second bearing surface and said second engagement surface is conical.

6. The bearing system as defined in claim 1, wherein at least one of said first bearing surface and said first engagement surface is generally convex and the other of said first bearing surface and said first engagement surface is generally concave.

7. The bearing system as defined in claim 1, wherein at least one of said second bearing surface and said second engagement surface is generally convex and the other of said second bearing surface and said second engagement surface is generally concave.

8. The bearing system as defined in claim 1, further comprising:

said first bearing configuration having a first cooperating member that is axially displaceable with respect to said first member; and a first biasing element that generally axially biases said first cooperating member towards said first member.

9. The bearing system as defined in claim 1, further comprising:

said second bearing configuration having a second cooperating member that is axially displaceable with respect to said second member; and a second biasing element that generally axially biases said second cooperating member towards said second member.

10. The bearing system as defined in claim 1, further comprising:

said first bearing configuration having a first cooperating member that is axially displaceable with respect to said first member;

a retainer that retains said first cooperating member with respect to said body portion; and said retainer having a biasing element that generally axially biases said first cooperating member towards said first member.

11. The bearing system as defined in claim 1, further comprising:

said second bearing configuration having a second cooperating member that is axially displaceable with respect to said second member; and a spring washer generally centered about said central axis that generally axially biases said second cooperating member towards said second member.

12. The bearing system as defined in claim 1, further comprising:

said first bearing configuration having a first cooperating member that is axially displaceable with respect to said first member;

a first biasing element that generally axially biases said first cooperating member towards said first member;

said second bearing configuration having a second cooperating member that is axially displaceable with respect to said second member;

a second biasing element that generally axially biases said second cooperating member towards said second member; and said first bearing configuration, said second bearing configuration, said first biasing element, and said second biasing element being configured to automatically generally center said spindle about said central axis and allow relative rotation between said spindle and said body portion upon the projectile experiencing in-flight forces.

13. The bearing system as defined in claim 1, further comprising:

said first bearing configuration having a first cooperating member that is axially displaceable with respect to said first member;

a first biasing element that generally axially biases said first cooperating member towards said first member;

said second bearing configuration having a second cooperating member that is axially displaceable with respect to said second member;

a second biasing element that generally axially biases said second cooperating member towards said second member; and said first bearing configuration, said second bearing configuration, said first biasing element, and said second biasing element being configured to generally automatically center said spindle about said central axis upon the projectile experiencing at least one of said set-back, set-forward, and balloting forces.

14. The bearing system as defined in claim 1, further comprising:

said first bearing configuration having a first cooperating member that is axially displaceable with respect to said first member; and a plurality of bearing elements interposed between said first member and said first cooperating member that facilitate relative rotation between said first member and said first cooperating member about said central axis.

15. The bearing system as defined in claim 1, further comprising:

said second bearing configuration having a second cooperating member that is axially displaceable with respect to said second member; and a plurality of bearing elements interposed between said second member and said second cooperating member that facilitate relative rotation between said second member and said second cooperating member about said central axis.

16. The bearing system as defined in claim 1, further comprising:

said second bearing configuration having a second cooperating member that is radially and axially displaceable with respect to said second member;

a biasing element generally that generally axially biases said second cooperating member towards said second member; and said second cooperating member being configured to cooperate with said second engagement surface such that radial movement of said second cooperating member exerts axial force against said axial bias of said biasing element.

17. The bearing system as defined in claim 1, further comprising:

said first bearing configuration having a first cooperating member that is radially and axially displaceable with respect to said first member;

a biasing element that generally axially biases said first cooperating member towards said first member; and said first cooperating member being configured to cooperate with said first engagement surface such that radial movement of said first cooperating member exerts axial force against said axial bias of said biasing element.

18. The bearing system as defined in claim 1, further comprising:

said first bearing configuration having a first cooperating member that is radially and axially displaceable with respect to said first member;

a first biasing element generally that generally axially biases said first cooperating member towards said first member;

said first cooperating member being configured to axially direct radial forces imparted thereto by said spindle to said first engagement surface;

said second bearing configuration having a second cooperating member that is radially and axially displaceable with respect to said second member;

a second biasing element generally that generally axially biases said second cooperating member towards said second member; and said second cooperating member being configured to axially direct radial forces imparted thereto by said spindle to said second engagement surface.

19. A projectile subject to set-back, set-forward and balloting during launch and pre-launch and in-flight forces, the projectile having a forward portion and a rearward portion, the projectile comprising:

a longitudinally extending body portion defining a central axis;

a spindle carried by said body portion;

a first bearing configuration having a first member;

a second bearing configuration having a second member;

said first bearing configuration and said second bearing configuration being configured to permit selective relative rotation between said spindle and said body portion about said central axis;

said first member defining a first bearing surface extending at a first angle with respect to said central axis;

a first engagement portion fixed relative to said body defining a first engagement surface extending at an angle substantially complimentary to said first angle of said first bearing surface;

said second member defining a second bearing surface extending at a second angle with respect to said central axis;

a second engagement portion fixed relative to said body defining a second engagement surface extending at an angle substantially complimentary to said second angle of said second bearing surface;

said first bearing surface being configured to engage said first engagement surface upon the projectile experiencing set-back forces;

said first bearing surface being configured to be substantially disengaged from said first engagement surface upon said projectile experiencing set-forward forces;

said second bearing surface being configured to be substantially disengaged from said second engagement surface upon said projectile experiencing set-back forces; and said second bearing surface being configured to engage said second engagement surface upon the projectile experiencing set-forward forces.

20. A bearing system for a projectile having a longitudinally extending body portion with a forward portion and a rearward portion and a spindle generally defining a central axis, the projectile being subject to pre-launch, launch, set-back, set-forward, balloting, and in-flight forces, the bearing system comprising:

a first bearing configuration proximate the forward portion of the body portion having a first member and a first cooperating member that is axially displaceable with respect to said first member;

a second bearing configuration proximate the rearward portion of the body portion having a second member and a second cooperating member that is axially displaceable with respect to said second member;

said first bearing configuration and said second bearing configuration being configured to permit selective relative rotation between said body portion and said spindle about said central axis;

said first member having a generally conical first bearing surface generally co-axial with said central axis;

a first engagement portion fixed relative to said body portion having a generally conical engagement surface configured to be generally nestable with said first bearing surface;

said second member having a generally conical second bearing surface generally co-axial with said central axis;

a second engagement portion fixed relative to said body portion having a generally conical second engagement surface configured to be generally nestable with said second bearing surface;

said first bearing surface being configured to engage said first engagement surface upon the projectile experiencing set-back forces;

said first bearing surface being configured to be substantially disengaged from said first engagement surface upon said projectile experiencing set-forward forces;

said second bearing surface being configured to be substantially disengaged from said second engagement surface upon said projectile experiencing set-back forces;

said second bearing surface being configured to engage said second engagement surface upon the projectile experiencing set-forward forces;

a first biasing element that biases said first cooperating member towards said first member;

a second biasing element that biases said second cooperating member towards said second member; and said first bearing configuration, said second bearing configuration, said first biasing element, and said second biasing element being configured to automatically generally center said spindle about said central axis and allow relative rotation between said spindle and said body member upon the projectile experiencing in-flight forces.

* * * * *